US009888782B1

(12) United States Patent
Jannke

(10) Patent No.: US 9,888,782 B1
(45) Date of Patent: Feb. 13, 2018

(54) TEMPERATURE CONTROLLED MATTRESS SYSTEM

(71) Applicant: Eastern Sleep Products Company, Richmond, VA (US)

(72) Inventor: Mark A. Jannke, Watertown, WI (US)

(73) Assignee: Eastern Sleep Products Company, Richmond, VA (US)

( * ) Notice: Subject to any disclaimer, the term of this patent is extended or adjusted under 35 U.S.C. 154(b) by 0 days.

(21) Appl. No.: 15/422,163

(22) Filed: Feb. 1, 2017

Related U.S. Application Data

(60) Provisional application No. 62/451,488, filed on Jan. 27, 2017.

(51) Int. Cl.
*A47C 21/04* (2006.01)
*A47C 27/14* (2006.01)
*A47C 31/00* (2006.01)

(52) U.S. Cl.
CPC ..... *A47C 21/04* (2013.01); *A47C 27/14* (2013.01); *A47C 31/001* (2013.01); *A47C 21/044* (2013.01); *A47C 27/144* (2013.01); *A47C 27/148* (2013.01)

(58) Field of Classification Search
CPC ..... A47C 21/04; A47C 21/042; A47C 21/044; A47C 21/048; A47C 27/00; A47C 27/002; A47C 27/005; A47C 27/006; A47C 27/007; A47C 27/12; A47C 27/122; A47C 27/14; A47C 27/142; A47C 27/144; A47C 27/146; A47C 27/148; A47C 27/15; A47C 27/22; A47C 31/00; A47C 31/001
USPC ..... 5/421, 423, 284, 652.1, 652.2, 724–726, 5/483, 698, 954, 740, 655.9, 953, 727, 5/728
See application file for complete search history.

(56) References Cited

U.S. PATENT DOCUMENTS 4,207,636 A * 6/1980 Ceriani ..... A47C 27/22 428/101
6,823,548 B2 * 11/2004 Murphy ..... A47C 31/001 5/698
7,240,386 B1 7/2007 McKay et al.
7,467,435 B1 12/2008 McKay et al.
7,996,936 B2 8/2011 Marquette et al.
8,065,763 B2 11/2011 Brykalski et al.
8,118,920 B2 2/2012 Vrzalik et al.
(Continued)

OTHER PUBLICATIONS

Memory Gel Featuring Phase Change Technology; http://www.innomax.com/index2.php?cm=272.

*Primary Examiner* — Robert G Santos
(74) *Attorney, Agent, or Firm* — McGuireWoods LLP

(57) ABSTRACT

A mattress assembly includes at least one core layer. The core layer having a top surface and a bottom surface. The assembly also includes at least one channel running through the core layer from the bottom surface to the top surface. In operation, the at least one channel receives temperature conditioned air flow at the bottom surface of the core layer. Additionally, the assembly includes a fluid permeable surface layer coupled to the top surface of the core layer and a fluid dispersal region positioned between the top surface of the core layer and the fluid permeable surface layer. Further, the assembly includes a quilted panel surrounding the core layer and the fluid permeable surface layer, and the quilted panel includes a plurality of fire retardant layers made from fiber material.

20 Claims, 5 Drawing Sheets

(56) References Cited

U.S. PATENT DOCUMENTS 8,181,290 B2 5/2012 Brykalski et al.
8,307,482 B2 11/2012 Gladney et al.
8,372,182 B2 2/2013 Vrzalik et al.
8,402,579 B2 3/2013 Marquette et al.
8,418,286 B2 4/2013 Brykalski et al.
8,732,874 B2 5/2014 Brykalski et al.
8,782,830 B2 7/2014 Brykalski et al.
8,813,279 B2 * 8/2014 Saunders ..... A47C 27/15 5/200.1
8,893,329 B2 * 11/2014 Petrovski ..... A47C 21/044 5/423
8,966,688 B2 * 3/2015 Blazar ..... A47C 27/14 5/691
9,125,497 B2 * 9/2015 Brykalski ..... A47C 21/048
9,259,099 B1 2/2016 Larsen et al.
9,265,352 B2 2/2016 Oakhill et al.
9,326,616 B2 5/2016 DeFranks et al.
9,603,459 B2 * 3/2017 Brykalski ..... A47C 21/044
9,622,588 B2 * 4/2017 Brykalski ..... A47C 21/04
2004/0060119 A1 * 4/2004 Murphy ..... A47C 31/001 5/698
2004/0060120 A1 * 4/2004 Murphy ..... A47C 31/001 5/698
2004/0158928 A1 * 8/2004 Gladney ..... A47C 31/001 5/698
2008/0148481 A1 * 6/2008 Brykalski ..... A47C 21/048 5/423
2010/0011502 A1 * 1/2010 Brykalski ..... A47C 21/048 5/423
2011/0115635 A1 * 5/2011 Petrovski ..... A47C 21/044 340/584
2011/0173757 A1 * 7/2011 Rensink ..... A47C 27/04 5/698
2012/0131748 A1 * 5/2012 Brykalski ..... A47C 21/048 5/423
2012/0227182 A1 * 9/2012 Brykalski ..... A47C 21/048 5/423
2012/0284918 A1 11/2012 Gazagnes
2013/0074273 A1 * 3/2013 Blazar ..... A47C 27/14 5/691
2013/0086743 A1 * 4/2013 Saunders ..... A47C 27/15 5/400
2013/0097776 A1 4/2013 Brykalski et al.
2013/0227783 A1 * 9/2013 Brykalski ..... A47C 21/044 5/423
2013/0269106 A1 * 10/2013 Brykalski ..... A47C 21/044 5/423
2014/0033441 A1 2/2014 Morgan et al.
2014/0109314 A1 4/2014 Boersma et al.
2014/0310874 A1 * 10/2014 Brykalski ..... A47C 21/044 5/423
2015/0040327 A1 * 2/2015 Mikkelsen ..... A47C 27/085 5/740
2015/0067967 A1 * 3/2015 Tyree ..... A47C 27/056 5/691
2015/0128351 A1 * 5/2015 Blazar ..... A47C 31/105 5/691
2015/0238020 A1 * 8/2015 Petrovski ..... A47C 21/048 5/421
2015/0289667 A1 * 10/2015 Oakhill ..... A47C 21/044 5/423
2015/0296994 A1 * 10/2015 Mikkelsen ..... A47C 21/042 5/655.4
2016/0166073 A1 * 6/2016 Oakhill ..... A47C 21/044 5/613
2017/0071359 A1 * 3/2017 Petrovski ..... A47C 21/044

* cited by examiner

TEMPERATURE CONTROLLED MATTRESS SYSTEM

CROSS-REFERENCE TO RELATED APPLICATIONS

This application claims benefit and priority to U.S. Provisional Application No. 62/451,488 filed Jan. 27, 2017, the disclosure of which is incorporated by reference herein in its entirety.

BACKGROUND

The present disclosure relates generally to the field of mattresses, and more particularly to mattresses with temperature controlled systems.

Heating and cooling systems may be employed in foam mattresses to adjust a temperature of a sleeping area. The heating and cooling systems may rely on convective air heating or cooling through foam of the mattress. Circulation of hot or cold air through the foam of the mattress presents challenges for even distribution of the hot and cold air over the entire mattress. For example, the foam may prevent conditioned air from reaching a surface of the mattress such that the effects of the conditioned air are felt at a sleeping surface of the mattress. Further, achieving a uniform temperature of the sleeping area or portions of the sleeping area may also be difficult due to the nature of the foam of the mattress.

Additionally, a fire retardant sock, which is generally included around a mattress for the mattress to meet upholstered furniture fire safety standards, may also affect the distribution of hot and cold air to the sleeping area of a mattress. For example, the fire retardant sock typically includes at least one layer of a fire retardant foam. In a manner similar to the foam of the mattress, the fire retardant foam of the fire retardant sock may prevent circulation of hot and cold air to the sleeping surface of the mattress.

SUMMARY

The disclosed embodiments provide details regarding temperature controlled mattresses. In accordance with an embodiment, a mattress assembly includes at least one core layer. The at least one core layer includes a top surface and a bottom surface. Additionally, the mattress assembly includes at least one channel running through the at least one core layer from the bottom surface to the top surface. In operation, the at least one channel receives temperature conditioned air flow at the bottom surface of the at least one core layer. Further, the mattress assembly includes a fluid permeable surface layer coupled to the top surface of the at least one core layer. A fluid dispersal region is positioned between the top surface of the at least one core layer and the fluid permeable surface layer. Also provided in the mattress assembly is a fire retardant quilted panel surrounding the at least one core layer and the fluid permeable surface layer. The fire retardant quilted panel includes a plurality of layers made from fiber material.

In accordance with another illustrative embodiment, a temperature controlled cushion system includes at least one core layer. The at least one core layer has a top surface and a bottom surface. Additionally, the system includes at least one channel running through the at least one core layer from the bottom surface to the top surface of the at least one core layer. Also provided in the system is at least one thermoelectric fan coupled to the at least one channel at the bottom surface of the at least one core layer. In operation, the at least one thermoelectric fan provides temperature conditioned air flow to the at least one channel. Further, the system includes a fluid permeable surface layer coupled to the top surface of the at least one core layer and a fluid dispersal region positioned between the top surface of the at least one core layer and the fluid permeable surface layer. Furthermore, a fire retardant quilted panel surrounding the at least one core layer and the fluid permeable surface layer is included in the system. The fire retardant quilted panel includes a plurality of layers made from fiber material.

In accordance with another illustrative embodiment, a temperature controlled mattress system includes at least one core layer. The at least one core layer includes a top surface and a bottom surface. The system also includes at least two channels running through the at least one core layer from the bottom surface to the top surface of the at least one core layer. Further, at least two thermoelectric fans are coupled individually to the at least two channels at the bottom surface of the at least one core layer. In operation, the at least two thermoelectric fans provide temperature conditioned air flow to the at least two channels, and the at least two thermoelectric fans and the at least two channels are controllable to generate at least two temperature control zones in the temperature controlled mattress system. Additionally, the system includes a fluid permeable surface layer coupled to the top surface of the at least one core layer and at least one fluid dispersal region positioned between the top surface of the at least one core layer and the fluid permeable surface layer. A fire retardant quilted panel surrounding the at least one core layer and the fluid permeable surface layer is also included in the system, and the fire retardant quilted panel includes a plurality of layers made from fiber material.

Additional details of the disclosed embodiments are provided below in the detailed description and corresponding drawings.

BRIEF DESCRIPTION OF THE DRAWINGS

Illustrative embodiments of the presently disclosed subject matter are described in detail below with reference to the attached figures, which are incorporated by reference herein, and wherein.

Figure 1:
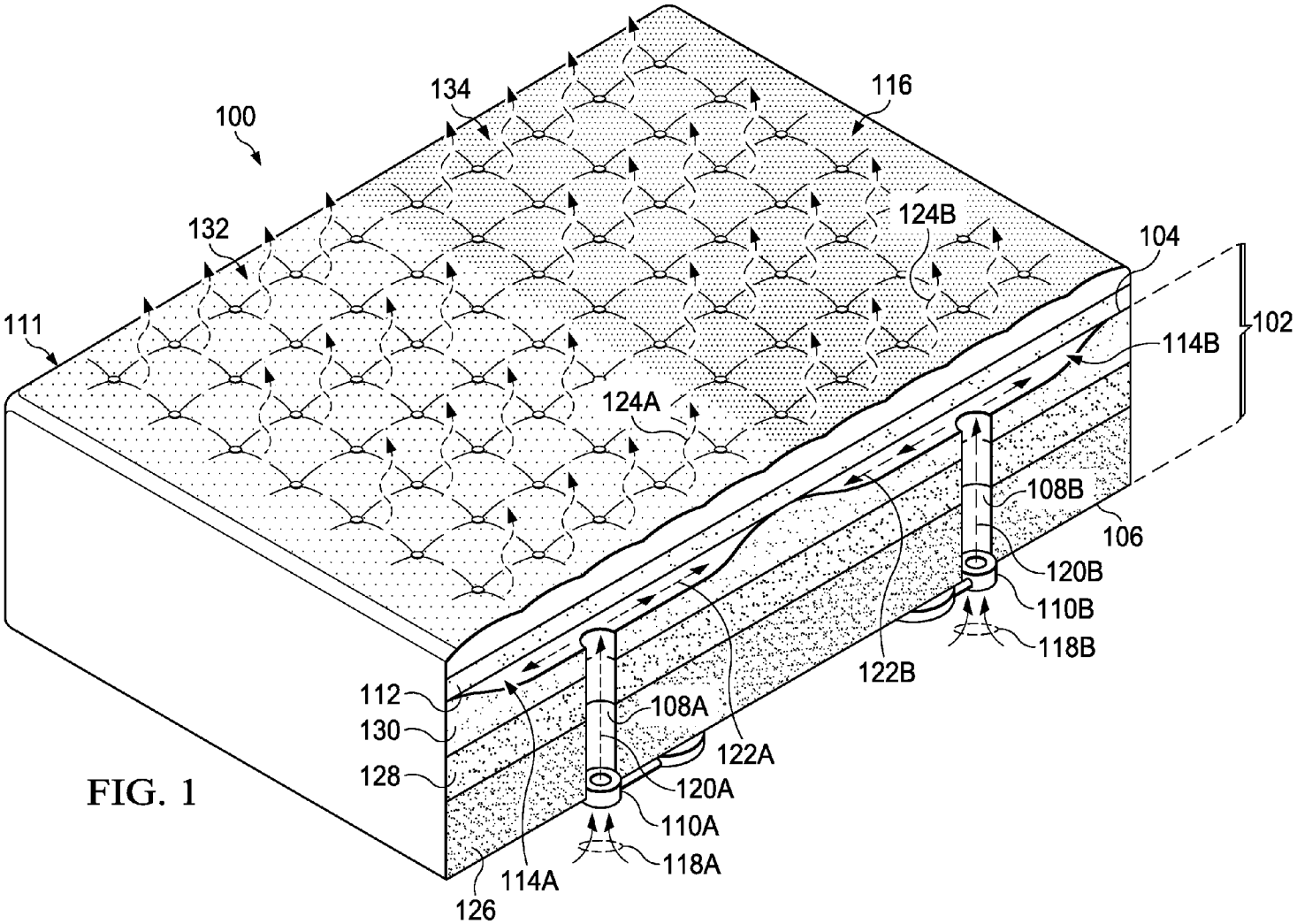
FIG. 1 is a cross section perspective view of a temperature controlled mattress system, in accordance with an embodiment.

The illustrated figures are only exemplary and are not intended to assert or imply any limitation with regard to the environment, architecture, design, or process in which different embodiments may be implemented.

DETAILED DESCRIPTION

In the following detailed description of several illustrative embodiments, reference is made to the accompanying drawings that form a part hereof, and in which is shown by way of illustration specific embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to". Unless otherwise indicated, as used throughout this document, "or" does not require mutual exclusivity.

The subject matter disclosed in the present application provides an assembly for a temperature controlled mattress. In specific applications, it is desirable for a mattress to include one or more controllable temperature zones. Accordingly, the mattress is designed to receive cooling or heating airflow and to disperse the cooling or heating airflow and the cooling or heating effects of the airflow across a sleeping surface of the mattress. Further, the mattress includes a quilted panel secured around the mattress that provides a fire retardant barrier and is made from layers of fiber material without any foam layers that may interfere with the cooling or heating airflow to the sleeping surface of the mattress. While the figures are generally directed to mattress systems, it may be appreciated that other cushioning systems are also contemplated using the same heating and cooling airflow technology. For example, couches, chairs, and other upholstered furniture may also be designed using the heating and cooling techniques described herein.

FIG. 1 is a cross section perspective view of a temperature controlled mattress system 100. In an embodiment, the temperature controlled mattress system 100 includes a core layer 102 of high density foam. A top surface 104 and a bottom surface 106 of the core layer 102 are also illustrated. A number of channels 108A and 108B run through the core layer 102 from the bottom surface 106 to the top surface 104. While only two channels 108A and 108B are depicted in FIG. 1, it may be appreciated that the temperature controlled mattress system 100 may include a single channel 108, or the temperature controlled mattress system 100 may include 3, 4, or more channels 108 while still falling within the scope of the presently disclosed subject matter. Further, while the figures depict the core layer 102 of high density foam, the core layer 102 may also include an innerspring mattress. In such an embodiment, the channels 108A and 108B may run through the core layer 102 between spring components of the innerspring mattress.

The channels 108A and 108B receive temperature conditioned airflow at the bottom surface 106 of the core layer 102 from thermoelectric fans 110A and 110B. In an embodiment, each of the channels 108A and 108B are coupled to an individual thermoelectric fan 110A and 110B, respectively, to provide the temperature conditioned airflow to a sleeping surface 111 of the temperature controlled mattress system 100. In another embodiment, each of the thermoelectric fans 110A and 110B may provide the temperature conditioned airflow to all of the channels 108 that are included within a temperature control zone to which the thermoelectric fans 110A and 110B are assigned. The temperature control zones, as used herein, may refer to zones of the temperature controlled mattress system 100 that are individually controllable to vary the temperature at the sleeping surface 111 at the individual temperature control zones. The thermoelectric fans 110A and 110B may be disposed within a box spring (not shown) or a mattress frame (not shown) positioned beneath and in physical contact with the temperature controlled mattress system 100.

Also included in the temperature controlled mattress system 100 is a fluid permeable surface layer 112 coupled to the top surface 104 of the core layer 102. The fluid permeable surface layer 112 may be made from a slow response gel foam or any other slow response foam that is capable of receiving and dispersing the air flow from the channels 108 to the sleeping surface 111. By way of example, the fluid permeable surface layer 112 may be made from a foam with a large cell structure. Further, the foam of the fluid permeable surface layer 112 may be at least one inch thick.

Spaces formed between the fluid permeable surface layer 112 and the top surface 104 of the core layer 102 may be used as fluid dispersal regions 114A and 114B. The fluid dispersal regions 114A and 114B may be confined to areas immediately surrounding the channels 108A and 108B, respectively, at the top surface 104 of the core layer 102. In another embodiment, the fluid dispersal regions 114A and 114B may extend through an entire temperature control zone and be positioned over several of the channels 108 positioned along the temperature control zone. Further, the fluid dispersal regions 114 may be in direct contact with the channels 108, the core layer 102 and the fluid permeable surface layer 112. That is, the fluid dispersal regions 114 may be entirely defined by the space between the core layer 102 and the fluid permeable surface layer 112 without any intervening materials. Accordingly, the airflow from the channels 108 is free to enter the fluid permeable surface layer 112 directly from the fluid dispersal regions 114. Further, in an embodiment, a density of the foam that makes up the fluid permeable surface layer 112 may be less than a density of the material that makes up the top surface 104 of the core layer 102. In this manner, the airflow is prevented from entering the core layer 102 and is encouraged to flow through the fluid permeable surface layer 112 to the sleeping surface 111.

In an embodiment, a quilted panel 116 is provided on the sleeping surface 111. The quilted panel 116 may also extend around the entire temperature controlled mattress system 100 to provide a fire retardant barrier around the temperature controlled mattress system 100. As discussed in detail below with reference to FIG. 6, the quilted panel 116 includes a plurality of fire retardant layers made from fiber material. Additionally, the quilted panel 116 is made without any layers of foam. Avoiding foam layers in the quilted panel 116 may limit an airflow dampening effect provided by foam used in a fire retardant layer. Accordingly, the layers made from fiber material (e.g., rayon and polyester) provide an easier path for the airflow to travel to the sleeping surface 111 than through a fire retardant barrier with one more layers of foam.

The thermoelectric fans 110A and 110B are capable of providing either hot or cold airflow to the channels 108 of the temperature controlled mattress system 100. The thermoelectric fans 110 operate by either venting away hot air to introduce cold air into the channels 108 or venting away cold air to introduce hot air into the channels 108. As depicted in FIG. 1, arrows 118A and 118B represent ambient airflow that enters the thermoelectric fans 110A and 110B, respectively. Within the thermoelectric fans 110A and 110B, the ambient airflow is conditioned to output cold airflow 120A or hot airflow 120B into the channels 108A and 108B, respectively. The cold airflow 120A and the hot airflow 120B then disperse into the fluid dispersal regions 114A and 114B, as indicated by arrows 122A and 122B. As the fluid dispersal regions 114A and 114B fill with the cold airflow 120A and the hot airflow 120B, respectively, the cold airflow 120A and the hot airflow 120B passes through the fluid permeable surface layer 112 and the quilted panel 116 to provide a cooling or heating effect on the sleeping surface 111, as indicated by the arrows 124A and 124B, respectively.

It may be appreciated that the core layer 102 may include several layers of foam that represent a base portion of the temperature controlled mattress system 100. As illustrated, the core layer 102 includes three layers 126, 128, and 130. As an example, the layer 126 may include a high density base foam, which functions as a foundation layer for the temperature controlled mattress system 100. Further, the layer 128 may be a support layer of less dense foam than the layer 126, but the support layer may include a foam that is denser than the layer 130. The layer 130, for example, may generally include a slow response memory foam layer that is less dense than the layers 128 and 126. In this manner, as the layers 126, 128, and 130 approach the sleeping surface 111, the density of the layers 126, 128, and 130 become less dense in relation to one another. Further, the top surface 104 of the core layer 102 (i.e., the top surface 104 of the layer 130) may be coated to prevent back flow of conditioned air into the core layer 102, which encourages the conditioned air from the channels 108 to flow through the fluid permeable surface layer 112. In another embodiment, the density of the foam in the layer 130 may be sufficiently greater than the density of the foam in the fluid permeable surface layer 112 such that the flow of conditioned fluid travels through the fluid permeable surface layer 112 without a significant amount of the conditioned fluid traveling into the layer 130.

Also illustrated are temperature control zones 132 and 134. As illustrated, the temperature controlled mattress system 100 includes the two temperature control zones 132 and 134. The thermoelectric fan 110A provides the temperature control zone 132 with the cold airflow 120A, while the thermoelectric fan 110B provides the temperature control zone 134 with the hot airflow 120B. The temperature control zones 132 and 134 may be split in such a manner to provide individualized temperature control for two users of the same mattress. In another embodiment, the temperature control zones 132 and 134 may be split in such a manner to provide different temperature control for a head and body of a user than the temperature control for a leg region of the user. While only two temperature control zones 132 and 134 are illustrated in FIG. 1, it may be appreciated that the temperature controlled mattress system 100 may include as many temperature control zones 132 and 134 as there are thermoelectric fans 110 providing conditioned airflow to the channels 108 of the temperature controlled mattress system 100. For example, in an embodiment with four thermoelectric fans 110 providing conditioned airflow to four or more channels 108, the temperature controlled mattress system 100 may include four different temperature control zones.

Figure 2:
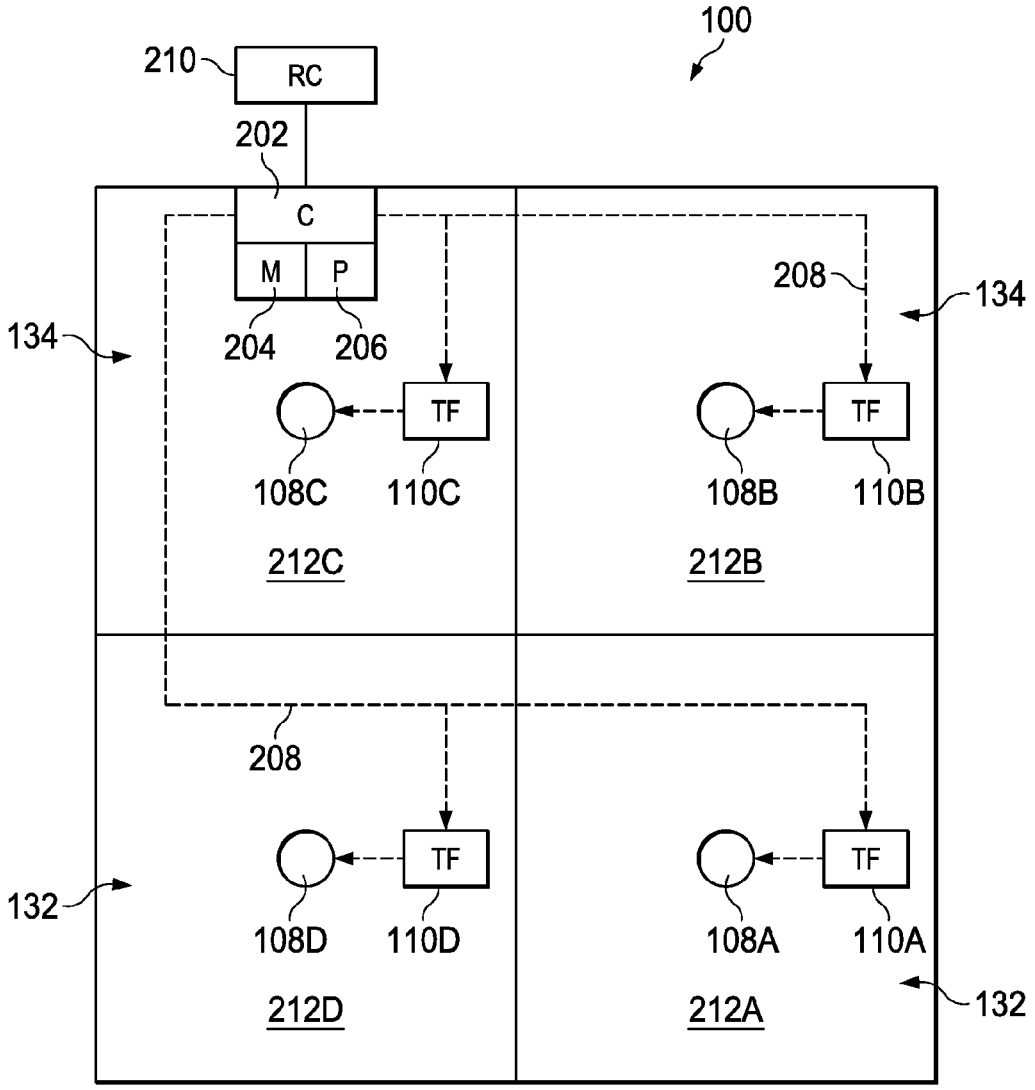
FIG. 2 is a schematic view of the temperature controlled mattress system of FIG. 1, in accordance with an embodiment.

Turning to FIG. 2, a schematic view the temperature controlled mattress system 100 is depicted. In an embodiment, the temperature controlled mattress system 100 includes a controller 202 that controls application of conditioned air to the channels 108A, 108B, 108C, and 108D. The controller 202 includes at least one memory element 204 and at least one processor 206. Instructions are stored in the memory element 204 and carried out by the processor 206 to control the thermoelectric fans 110 coupled to each of the channels 108A, 108B, 108C, and 108D. In particular, the processor 206, when executing the instruction of the memory element 204, instructs the controller 202 to provide signals along signal lines 208 that control operation of the thermoelectric fans 110A, 110B, 110C, and 110D. For example, the controller 202 may provide on/off signals and temperature control signals to the thermoelectric fans 110A-110D along the signal lines 208.

The controller 202 may be controlled by a remote control 210. The remote control 210 enables a user of the temperature controlled mattress system 100 to control the temperature control zones 132 and 134 remotely via the controller 202. In some embodiments, the remote control 210 may be a smart device (e.g., a phone or tablet device) with an application that communicatively connects with the controller 202 wirelessly for the user to control operation of the thermoelectric fans 110A-110D.

Further, while FIG. 1 depicts the two temperature control zones 132 and 134, FIG. 2 depicts an embodiment with four different temperature control zones 212A, 212B, 212C, and 212D. By way of example, temperature control zones 212B and 212C may represent a head and body region of two separate users of the temperature controlled mattress system 100, while temperature control zones 212A and 212D represent a leg region of the two separate users of the temperature controlled mattress system 100. In the illustrated embodiment, the controller 202 provides signals to the thermoelectric fans 110A-110D individually. Accordingly, as an example, a user may control the thermoelectric fan 110C to provide cold airflow to the temperature control zone 212C and the thermoelectric fan 110D to provide hot airflow to the temperature control zone 212D. At the same time, a separate user may control the thermoelectric fans 110B and 110A to both provide cold airflows to the temperature control zones 212B and 212A. Further, any other combination of hot and cold airflow may be provided by the thermoelectric fans 110A-110D to the temperature control zones 212A-212D based on user inputs to the remote control 210.

Figure 3:
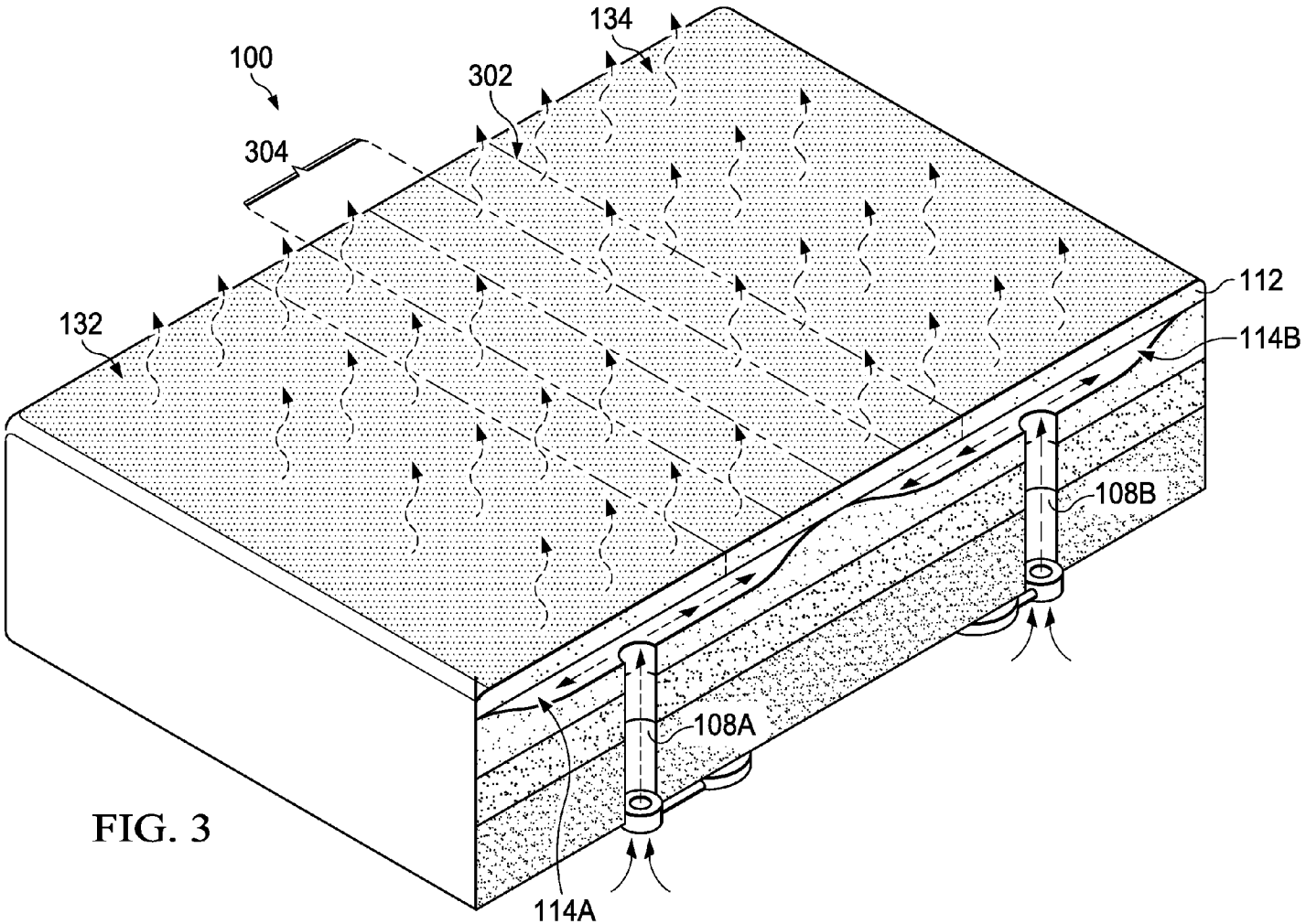
FIG. 3 is a cross section perspective view of a temperature controlled mattress system including a phase change material, in accordance with an embodiment.

FIG. 3 is a cross section perspective view of the temperature controlled mattress system 100 including a phase change material layer 302. When the temperature controlled mattress system 100 includes multiple temperature control zones, such as the temperature control zones 132 and 134, a portion 304 of the temperature controlled mattress system 100 may not be in contact with the fluid dispersal regions 114A and 114B. Accordingly, when hot airflow or cold airflow is supplied to the fluid dispersal regions 114A and 114B, the portion 304 of the temperature controlled mattress system 100 may not provide as significant of a heating or cooling effect as a remainder of the temperature controlled mattress system 100. Such an effect may be particularly noticeable when the thermoelectric fans 110 are in a cooling mode due to a general difficulty of producing a cooling effect in the temperature controlled mattress system 100 when compared to producing a heating effect in the temperature controlled mattress system 100.

To combat the reduced effectiveness of the cooling function across the portion 304 of the temperature controlled mattress system 100, the phase change material layer 302 may be applied within a portion of the fluid permeable surface layer 112. The phase change material layer 302 assists in dissipating heat when the thermoelectric fans 110 are in the cooling mode. Additionally, the phase change material layer 302 may prove particularly effective when both of the temperature control zones 132 and 134 are in a cooling mode. The phase change material layer 302 may absorb heat generated by a user in contact with the phase change material layer 302. Because the phase change material layer 302 absorbs heat, a surface of the phase change material layer 302 feels cool to the touch when a user is in contact with the surface.

In the illustrated embodiment, the phase change material layer 302 is provided over a middle third of the temperature controlled mattress system 100. In this manner, the phase change material layer 302 may cover the portion 304 of the temperature controlled mattress system 100 and overlap portions of the fluid dispersal regions 114A and 114B. In the cooling mode, such an arrangement may provide a continuous cooling effect over the entire temperature controlled mattress system 100.

Figure 4:
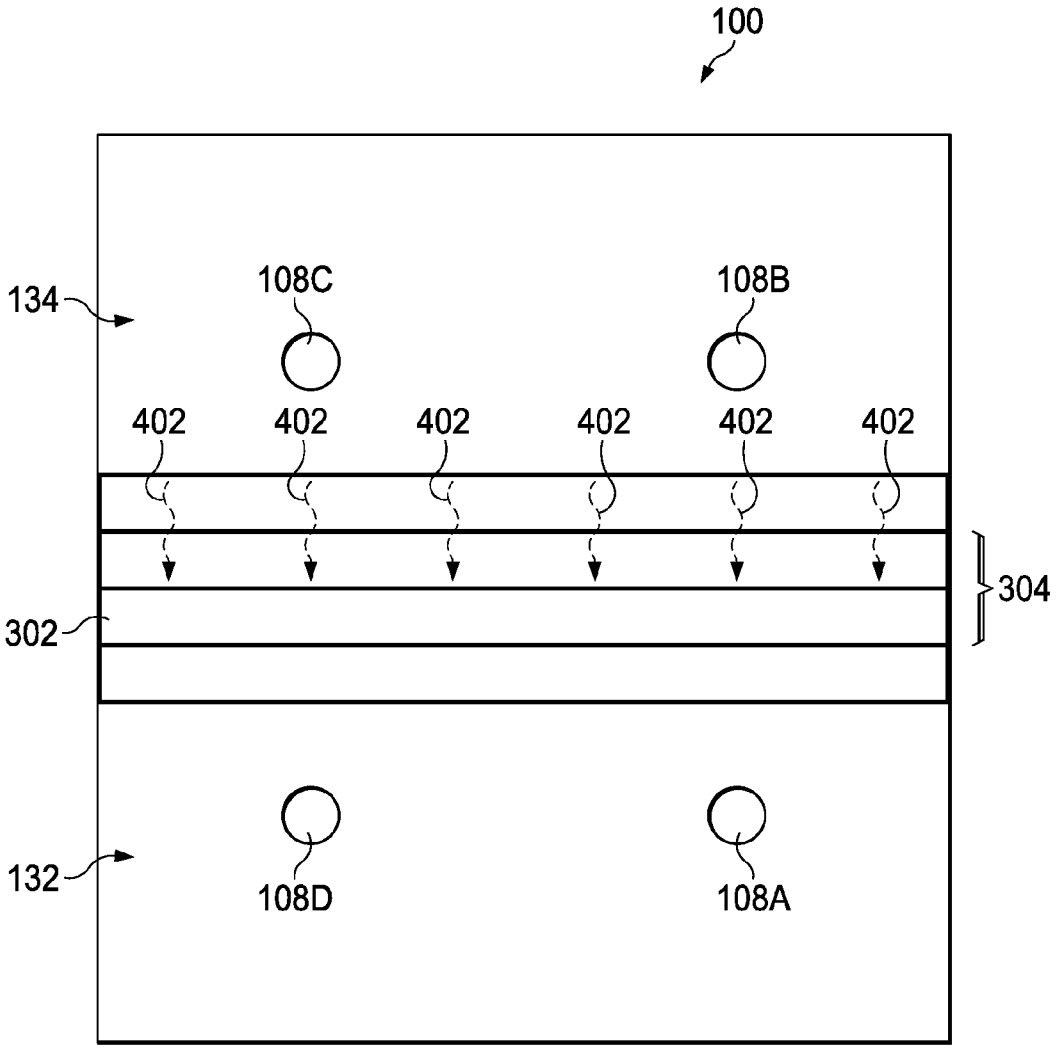
FIG. 4 is a schematic view of the temperature controlled mattress system of FIG. 3, in accordance with an embodiment.

FIG. 4 is a schematic view of the temperature controlled mattress system 100 and the phase change material layer 302. As discussed above with reference to FIG. 4, the phase change material layer 302 absorbs heat, as indicated by arrows 402. Accordingly, extra heat generated by a user over the phase change membrane layer 302 is dissipated from a surface of the phase change membrane layer 302. Dissipation of the extra heat from the surface results in a cooling sensation at the surface of the phase change membrane layer 302. The cooling effect may be particularly useful over the portion 304 of the temperature controlled mattress system 100 between the temperature control zones 132 and 134 when the temperature control zones 132 and 134 are both in the cooling mode.

Figure 5:
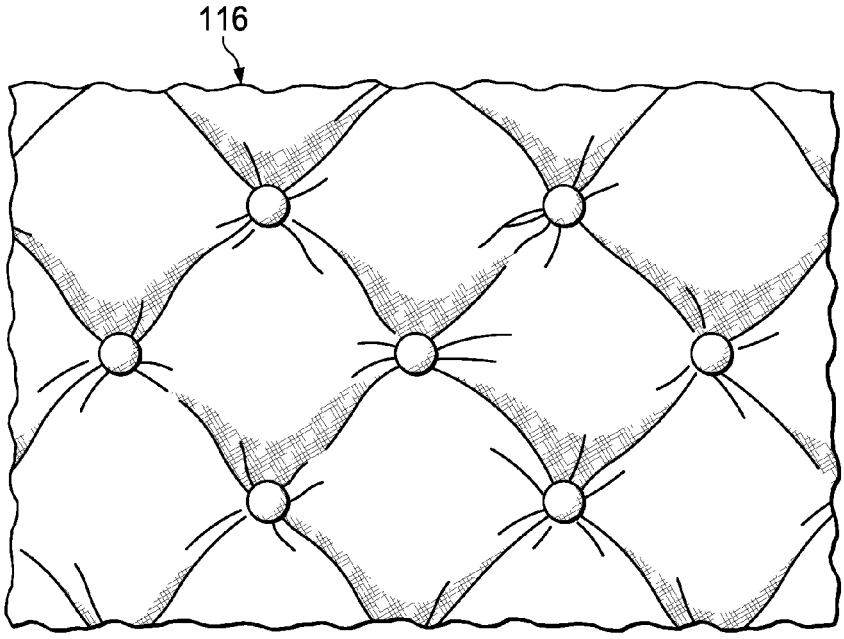
FIG. 5 is a top view of a quilted panel, in accordance with an embodiment.

Turning to FIG. 5, a top view of the quilted panel 116 is depicted. In an embodiment, the quilted panel 116 is made entirely from fibrous materials. The quilted panel 116 may reduce a restriction of airflow from the fluid dispersal regions 114 as compared to a fire retardant layer that is not made entirely from fibrous materials (e.g., a fire retardant layer that includes a fire retardant foam layer). The quilted panel 116 may surround the entire temperature controlled mattress system 100 to meet fire retardant regulations associated with furniture.

Figure 6:
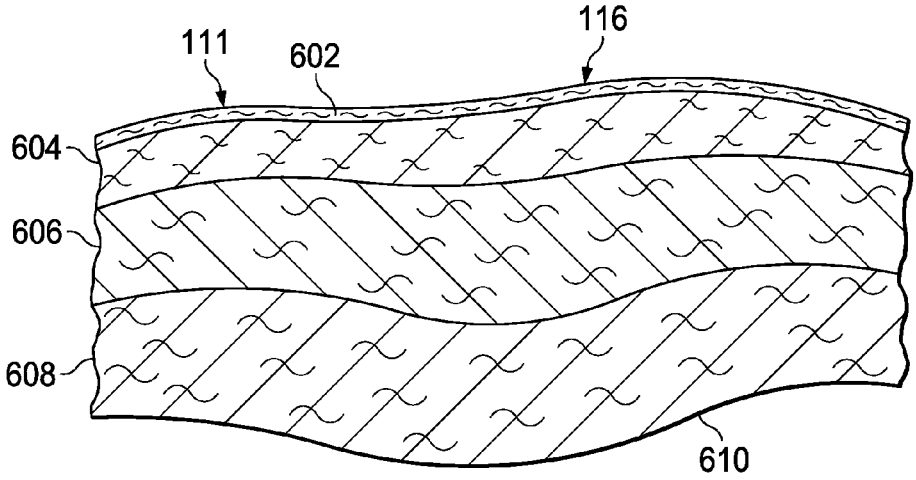
FIG. 6 is a side cross section view of the quilted panel of FIG. 5, in accordance with an embodiment.

FIG. 6 is a cross section view of the quilted panel 116. In an embodiment, the quilted panel 116 includes a breathable top fabric 602. The breathable top fabric 602 assists in enabling airflow from the fluid dispersal regions 114 to travel to the sleeping surface 111 of the temperature controlled mattress system 100 due to the breathable nature of the fabric. That is, the breathable top fabric 602 provides a negligible resistance to the airflow from the fluid dispersal regions 114 to the sleeping surface 111.

The quilted panel 116 also includes a fire retardant layer of rayon 604 directly beneath the breathable top fabric 602 and layers 606 and 608 of polyester beneath the fire retardant layer of rayon 604. The layers 606 and 608 of polyester may be a high loft Dacron polyester (i.e., polyethylene terephthalate). The high loft of the layers 606 and 608 provides the quilted panel 116 with the visible quilted height. Further, the fire retardant layer of rayon 604 prevents a flame from travelling from the sleeping surface 111 of the temperature controlled mattress system 100 to the foam layers of the temperature controlled mattress system 100.

As mentioned above, the quilted panel 116 is positioned above the fluid permeable surface layer 112 to create the sleeping surface 111. Further, in an embodiment, the quilted panel 116 is also positioned around sides of the core layer 102 and around a bottom surface 106 of the core layer 102 to create a fire retardant layer of the quilted panel 116 around the entire temperature controlled mattress system 100. Further, it may be appreciated that while FIG. 6 depicts a layer of rayon 604 and two layers 606 and 608 of polyester, more or fewer layers of fire retardant and non-fire retardant fibrous material may also be deployed to make up the quilted panel 116. Further, as the quilted panel 116 is composed entirely of fibrous materials, no foam layers are provided in the quilted panel 116 that would interfere with the airflow from the fluid dispersal regions 114 to the sleeping surface 111.

While this specification provides specific details related to certain components of the temperature controlled mattress system 100, it may be appreciated that the list of components is illustrative only and is not intended to be exhaustive or limited to the forms disclosed. Other components of the temperature controlled mattress system 100 will be apparent to those of ordinary skill in the art without departing from the scope and spirit of the disclosure. Further, the scope of the claims is intended to broadly cover the disclosed components and any such components that are apparent to those of ordinary skill in the art.

The above disclosed embodiments have been presented for purposes of illustration and to enable one of ordinary skill in the art to practice the disclosed embodiments, but is not intended to be exhaustive or limited to the forms disclosed. Many insubstantial modifications and variations will be apparent to those of ordinary skill in the art without departing from the scope and spirit of the disclosure. The scope of the claims is intended to broadly cover the disclosed embodiments and any such modification.

It should be apparent from the foregoing disclosure of illustrative embodiments that significant advantages have been provided. The illustrative embodiments are not limited solely to the descriptions and illustrations included herein and are instead capable of various changes and modifications without departing from the spirit of the disclosure.

What is claimed is:

1. A mattress assembly, comprising:

at least one core layer, the at least one core layer comprising a top surface and a bottom surface;

at least one channel running through the at least one core layer from the bottom surface to the top surface, the at least one channel configured to receive temperature conditioned air flow at the bottom surface of the at least one core layer;

a fluid permeable surface layer coupled to the top surface of the at least one core layer;

a fluid dispersal region comprising a space defined by the at least one core layer and the fluid permeable surface layer, wherein the air flow from the at least one channel is free to enter the fluid permeable surface layer directly from the fluid dispersal region, and wherein a first density of the fluid permeable surface layer adjacent to the fluid dispersal region is lower than a second density of the at least one core layer adjacent to the fluid dispersal region; and a fire retardant quilted panel surrounding the at least one core layer and the fluid permeable surface layer, wherein the quilted panel comprises a plurality of layers made from fiber material.

2. The assembly of claim 1, wherein at least a portion of the fluid permeable surface layer comprises a slow response gel foam with a phase change material.

3. The assembly of claim 2, wherein the portion of the fluid permeable surface layer comprises at least a third of the fluid permeable surface layer.

4. The assembly of claim 1, wherein the fire retardant quilted panel comprises a first layer of fire retardant rayon and second and third layers of high loft polyethylene terephthalate.

5. The assembly of claim 1, wherein the fire retardant quilted panel consists of a breathable fabric, a first layer of fire retardant rayon, and at least one layer of polyester fibers.

6. The assembly of claim 5, wherein the breathable fabric of the fire retardant quilted panel forms a sleeping surface of the mattress assembly.

7. The assembly of claim 1, wherein the fluid dispersal region is defined by a space between an underside of the fluid permeable surface layer and the top surface of the at least one core layer.

8. The assembly of claim 1, wherein the at least one channel comprises at least two channels running through the at least one core layer from the bottom surface to the top surface, and the at least two channels provide at least two temperature control zones in the mattress assembly.

9. The assembly of claim 1, wherein the at least one channel comprises at least four channels, and each of the at least four channels comprises a separate temperature control zone.

10. The assembly of claim 1, wherein the at least one core layer comprises a foundation layer with a first foam density and a support layer with a second foam density, wherein the first foam density is greater than the second foam density.

11. A temperature controlled cushion system, comprising:

at least one core layer comprising a top surface and a bottom surface;

at least one channel running through the at least one core layer from the bottom surface to the top surface of the at least one core layer;

at least one thermoelectric fan coupled to the at least one channel at the bottom surface of the at least one core layer, the at least one thermoelectric fan configured to provide temperature conditioned air flow to the at least one channel;

a fluid permeable surface layer coupled to the top surface of the at least one core layer;

a fluid dispersal region comprising a space defined by the at least one core layer and the fluid permeable surface layer, wherein the air flow from the at least one channel is free to enter the fluid permeable surface layer directly from the fluid dispersal region, and wherein a first density of the fluid permeable surface layer adjacent to the fluid dispersal region is lower than a second density of the at least one core layer adjacent to the fluid dispersal region; and a fire retardant quilted panel surrounding the at least one core layer and the fluid permeable surface layer, wherein the quilted panel comprises a plurality of layers made from fiber material.

12. The system of claim 11, wherein the fire retardant quilted panel comprises a first layer of fire retardant rayon and second and third layers of high loft polyethylene terephthalate.

13. The system of claim 11, wherein the fire retardant quilted panel consists of at least one layer of a breathable fabric, a first layer of fire retardant rayon, and at least one layer of polyester fibers.

14. The system of claim 11, wherein at least a portion of the fluid permeable surface layer comprises a slow response gel foam with a phase change material.

15. The system of claim 11, wherein the fluid dispersal region is defined by a space between an underside of the fluid permeable surface layer and the top surface of the at least one core layer.

16. The system of claim 11, wherein one channel of the at least one channel, one thermoelectric fan of the at least one thermoelectric fan, and one fluid dispersal region of the at least one fluid dispersal region comprise a temperature control zone of the temperature controlled cushion system.

17. A temperature controlled mattress system, comprising:

at least one core layer comprising a top surface and a bottom surface;

at least two channels running through the at least one core layer from the bottom surface to the top surface of the at least one core layer;

at least two thermoelectric fans coupled individually to the at least two channels at the bottom surface of the at least one core layer, the at least two thermoelectric fans configured to provide temperature conditioned air flow to the at least two channels, wherein the at least two thermoelectric fans and the at least two channels are controllable to generate at least two temperature control zones in the temperature controlled mattress system;

a fluid permeable surface layer coupled to the top surface of the at least one core layer;

at least one fluid dispersal region comprising a space defined by the at least one core layer and the fluid permeable surface layer, wherein the air flow from the at least one channel is free to enter the fluid permeable surface layer directly from the fluid dispersal region, and wherein a first density of the fluid permeable surface layer adjacent to the at least one fluid dispersal region is lower than a second density of the at least one core layer adjacent to the at least one fluid dispersal region; and a fire retardant quilted panel surrounding the at least one core layer and the fluid permeable surface layer, wherein the quilted panel comprises a plurality of layers made from fiber material.

18. The system of claim 17, wherein the at least one fluid dispersal region comprises four fluid dispersal regions and the at least two channels comprise four channels, and wherein each of the four fluid dispersal regions are formed in fluid communication with one of the four channels.

19. The system of claim 17, wherein fire retardant quilted panel comprises a first layer of fire retardant rayon, and second and third layers of high loft polyester.

20. The system of claim 17, wherein at least a portion of the fluid permeable surface layer comprises a slow response gel foam with a phase change material.

* * * * *